United States Patent [19]

Kimura

[11] Patent Number: 4,916,488

[45] Date of Patent: Apr. 10, 1990

[54] AUTO-TONER SENSOR

[75] Inventor: Masashi Kimura, Yokohama, Japan

[73] Assignee: Kabushiki Kaisha Toshiba, Kawasaki, Japan

[21] Appl. No.: 288,074

[22] Filed: Dec. 21, 1988

[30] Foreign Application Priority Data

Dec. 29, 1987 [JP] Japan ..... 62-335037

[51] Int. Cl.[4] ..... G03G 21/00

[52] U.S. Cl. ..... 355/208; 118/689; 355/246

[58] Field of Search ..... 355/246, 208, 251; 118/689, 690, 691

[56] References Cited

U.S. PATENT DOCUMENTS

| | | | |
|---|---|---|---|
| 4,592,645 | 6/1986 | Kanai et al. | 355/246 X |
| 4,708,458 | 11/1987 | Ueda et al. | 355/246 X |
| 4,742,370 | 5/1988 | Murakami et al. | 355/246 |
| 4,801,980 | 1/1989 | Arai et al. | 118/689 X |

FOREIGN PATENT DOCUMENTS

| | | | |
|---|---|---|---|
| 0128471 | 7/1985 | Japan | 355/246 |
| 0164068 | 7/1987 | Japan | 355/246 |
| 1116782 | 6/1968 | United Kingdom . | |
| 1405783 | 9/1975 | United Kingdom . | |
| 1597010 | 9/1981 | United Kingdom . | |
| 2099144 | 12/1982 | United Kingdom . | |

*Primary Examiner*—A. T. Grimley
*Assistant Examiner*—Robert Beatty
*Attorney, Agent, or Firm*—Foley & Lardner, Schwartz, Jeffery, Schwaab, Mack, Blumenthal & Evans

[57] ABSTRACT

An auto-toner sensor capable of performing an initial adjustment of the sensitivity of toner density detection automatically by means of a simple configuration is disclosed. The auto-toner sensor includes a sensor for detecting a toner density, and producing a sensor output signal indicating the detected toner density, the sensitivity of the sensor being adjustable by a control signal to be supplied to the sensor; a device for comparing a value of the sensor output signal with a prescribed reference value indicating an appropriate level of the toner density, to produce a comparison signal indicating a result of the comparison; and a device for producing in accordance with the comparison signal a control signal, to be given to the sensor, which adjusts the sensitivity of the detection of the toner density, the control signal having a value such that the value of the sensor output signal is substantially equal to that of the reference value when the toner has the density at the appropriate level.

8 Claims, 3 Drawing Sheets

AUTO-TONER SENSOR

BACKGROUND OF THE INVENTION

1. Field of the Invention

The present invention relates to an auto-toner sensor for controlling the toner density in a process of developing a latent image obtained from a manuscript.

2. Description of Prior Art

In general, an auto-toner sensor using a sensor such as a magnetic type sensor is provided in the copy machine utilizing a two-component developing method by electrophotography in order to maintain the density of the toner at an appropriate level.

Such an auto-toner sensor is shown in FIG. 1. In this auto-toner sensor, a control voltage $V_{cnt}$ obtained as a power supply voltage $V_{cc}$ divided by a variable resistance VR is applied to a control terminal of a sensor 10, which affects the sensitivity in toner density detection. In response to this control signal $V_{cnt}$, the sensor 10 detects a toner density and produces a sensor output voltage $V_{out}$ which is a DC voltage proportional to the detected toner density.

In such a conventional auto-toner sensor, it is necessary to adjust the variable resistance initially such that the sensor output voltage $V_{out}$ for toner of standard density is equal to a predetermined standard value. The toner is absorbed on the latent image obtained from the manuscript at an appropriate level only after the sensor output voltage $V_{out}$ is adjusted with respect to the standard value by this initial adjustment.

Now, the sensor output voltage $V_{out}$ may vary because of the variation in the sensitivity of the detection by the sensor 10, an environmental condition of the copy machine such as a humidity, and the variation of the toner density. As a result, in the conventional auto-toner sensor, the initial adjustment of the sensor output voltage $V_{out}$ with respect to the standard value has to be carried out by the operator manually.

However, due to the subtlety of the toner absorption by the drum, high accuracy is required for this adjustment, and this has proven to be enormously cumbersome operation for the operator to perform.

SUMMARY OF THE INVENTION

It is therefore an object of the present invention to provide an auto-toner sensor capable of performing the initial adjustment of the sensitivity of toner density detection automatically by means of a simple configuration.

According to one aspect of the present invention there is an auto-toner sensor, comprising: sensor means for detecting a toner density, and producing a sensor output signal indicating the detected toner density, a sensitivity of the sensor means being adjustable by a control signal to be supplied to the sensor means; means for comparing a value of the sensor output signal with a prescribed reference value indicating an appropriate level of the toner density, to produce a comparison signal indicating a result of the comparison; and means for producing in accordance with the comparison signal a control signal, to be given to the sensor means, which adjusts the sensitivity of the detection of the toner density, the control signal having a value such that the value of the sensor output signal is substantially equal to that of the reference value when the toner has the density at the appropriate level.

According to another aspect of the present invention there is provided a toner supplying apparatus, comprising: sensor means for detecting a toner density, and producing a sensor output signal indicating the detected toner density, a sensitivity of the sensor means being adjustable by a control signal to be supplied to the sensor means; means for comparing a value of the sensor output signal with a prescribed reference value indicating an appropriate level of the toner density, to produce a comparison signal indicating a result of the comparison; means for producing in accordance with the comparison signal a control signal, to be given to the sensor means, which adjusts the sensitivity of the detection of the toner density, the control signal having a value such that the value of the sensor output signal is substantially equal to that of the reference value when the toner has the density at the appropriate level; memory means for memorizing the value of the control signal; and means for controlling a supply of toner such that the toner is supplied only when a value of the sensor output signal differs from the reference value in a manner indicating that the toner density is lower than the appropriate level, while the control signal having the memorized value is being supplied to the sensor means.

Other features and advantages of the present invention will become apparent from the following description taken in conjunction with the accompanying drawings.

DETAILED DESCRIPTION OF THE PREFERRED EMBODIMENTS

Figure 1:
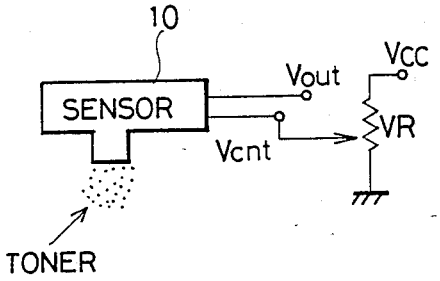
FIG.1 (PRIOR ART)
FIG. 1 is a schematic block diagram of a conventional auto-toner sensor.
Figure 2:
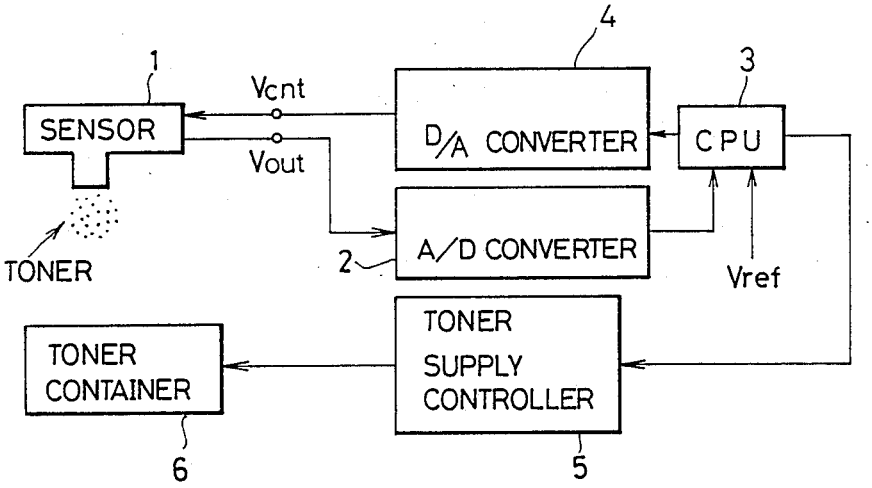
FIG. 2 is a schematic block diagram of one embodiment of an auto-toner sensor according to the present invention.

Referring now to FIG. 2, there is shown one embodiment of an auto-toner sensor according to the present invention.

This auto-toner sensor is comprised of the following.

A sensor 1 detects a toner density and produces a sensor output voltage $V_{out}$ which indicates the toner density detected.

An A/D converter 2 converts the sensor output voltage $V_{out}$ from analog to digital.

A CPU 3 derives an adjusted voltage $V_{ad}$, not shown, from a prescribed reference voltage $V_{ref}$ which indicates an appropriate toner density and the sensor output voltage $V_{out}$, and produces a control voltage $V_{cnt}$ which indicates a necessary adjustment to be made in the toner density detection by the sensor 1, as well as a toner control signal, not shown, which indicates an appropriate amount of toner need to be supplied in accordance with the adjusted voltage $V_{ad}$.

A D/A converter 4 converts the control signal $V_{cnt}$ from digital to analog.

A toner supply controller 5 controls an actual supply of the toner in accordance with the toner control signal.

A toner container 6 contains the toner and releases an appropriate amount of the toner under the control of the toner supply controller 5.

Figure 3:
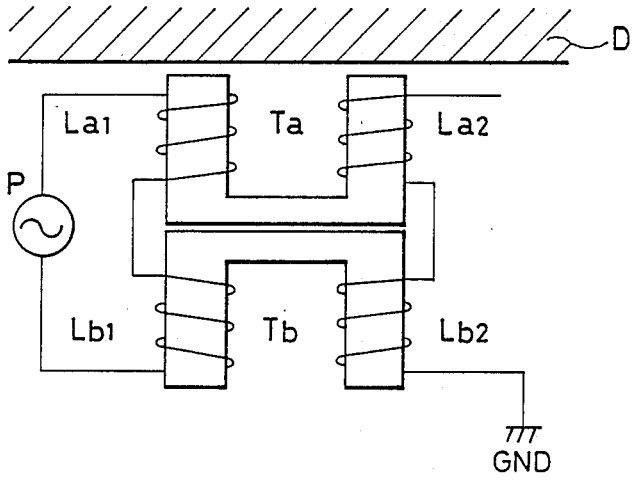
FIG. 3 is a magnified view of a detection head of a sensor of the auto-toner sensor shown in FIG. 2.

FIG. 3 shows a detection head of the sensor 1. The detection head is comprised of two U-shaped transformers Ta and Tb arranged to point in the opposite directions. The transformer Ta is called the detection-side transformer and the transformer Tb is called the comparison-side transformer. Primary coils La1 and Lb1 are connected in series to an oscillator P which supplies an AC current so that an electromotive force results in secondary coils La2 and Lb2. As the coil La2 and Lb2 are connected in reverse polarity, the output of the coil Lb2 is phase-lagged by 180° behind those of the oscillator P and the coil La2. The output of the detection head is obtained as a combination of the outputs of the secondary coils La2 and Lb2, which is subsequently amplified and then a phase difference with respect to a standard phase waveform of 180° phase lag from that of the oscillator is produced as the sensor output voltage $V_{out}$.

When the toner in a developer material D is consumed and the specific toner density is lowered, the coupling degree of the detection-side transformer Ta, an induced electromotive force of the coil La2, and a component of the detection head output which has the same phase as that of the oscillator P's output are all increased. As a result, the phase difference between the detection head output and the standard phase waveform is increased, and consequently, the sensor output voltage $V_{out}$ increases.

The sensor output voltage $V_{out}$ can be adjusted by varying the coupling degree of the comparison-side transformer Tb which can be actuated by the control voltage $V_{cnt}$.

This control voltage $V_{cnt}$ is obtained from the adjusted voltage $V_{ad}$ at the CPU 3 by applying a negative feedback such as one that can be obtained conventionally by means of a differential amplifier.

Figure 4A:
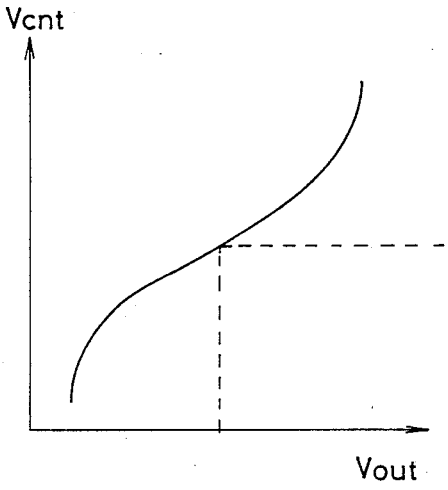
FIG. 4 (*a*) and (*b*) are graphs showing the relationships among a sensor output voltage, a control voltage, and an adjusted voltage to be utilized in the auto-toner sensor shown in FIG. 2.
Figure 4B:
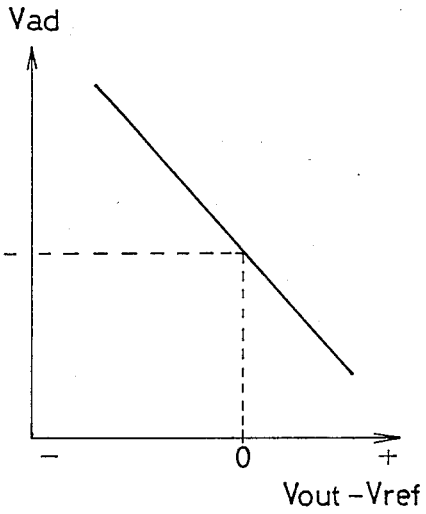

FIG. 4 shows an ideal relationships among the sensor output voltage $V_{out}$, the control voltage $V_{cnt}$ and the adjusted voltage $V_{ad}$. This serves as an ultimate target which the initial adjustment is carried out to achieve.

When the control voltage $V_{cnt}$ is a continuously increasing function of the sensor output voltage $V_{out}$, as shown in FIG. 4 (*a*), the adjusted voltage $V_{ad}$ is to be such that as the sensor output voltage $V_{out}$ increases with respect to the reference voltage $V_{ref}$ the adjusted voltage $V_{ad}$ decreases, as shown in FIG. 4 (*b*). In this situation, when the sensor output voltage Vout is greater than the reference voltage $V_{ref}$, the sensor output voltage $V_{out}$ can be adjusted to approach the reference voltage $V_{ref}$ by lowering the control voltage $V_{cnt}$, and when the sensor output voltage $V_{out}$ is less than the reference voltage $V_{ref}$, the sensor output voltage $V_{out}$ can be adjusted to approach the reference voltage $V_{ref}$ by raising the control voltage $V_{cnt}$.

On the other hand, the CPU 3 compares the sensor output voltage $V_{out}$ with the reference voltage $V_{ref}$, the result of which is utilized in judging the change of the toner density. Also when the sensor output voltage $V_{out}$ and the reference voltage $V_{ref}$ are equal, the value of the adjusted voltage $V_{ad}$ at that moment is memorized by a memory of the CPU 3. The memorized value of the adjusted voltage $V_{ad}$ is utilized in the toner density control operations as a target value with respect to which the amount of the toner to be supplied is controlled.

Figure 5:
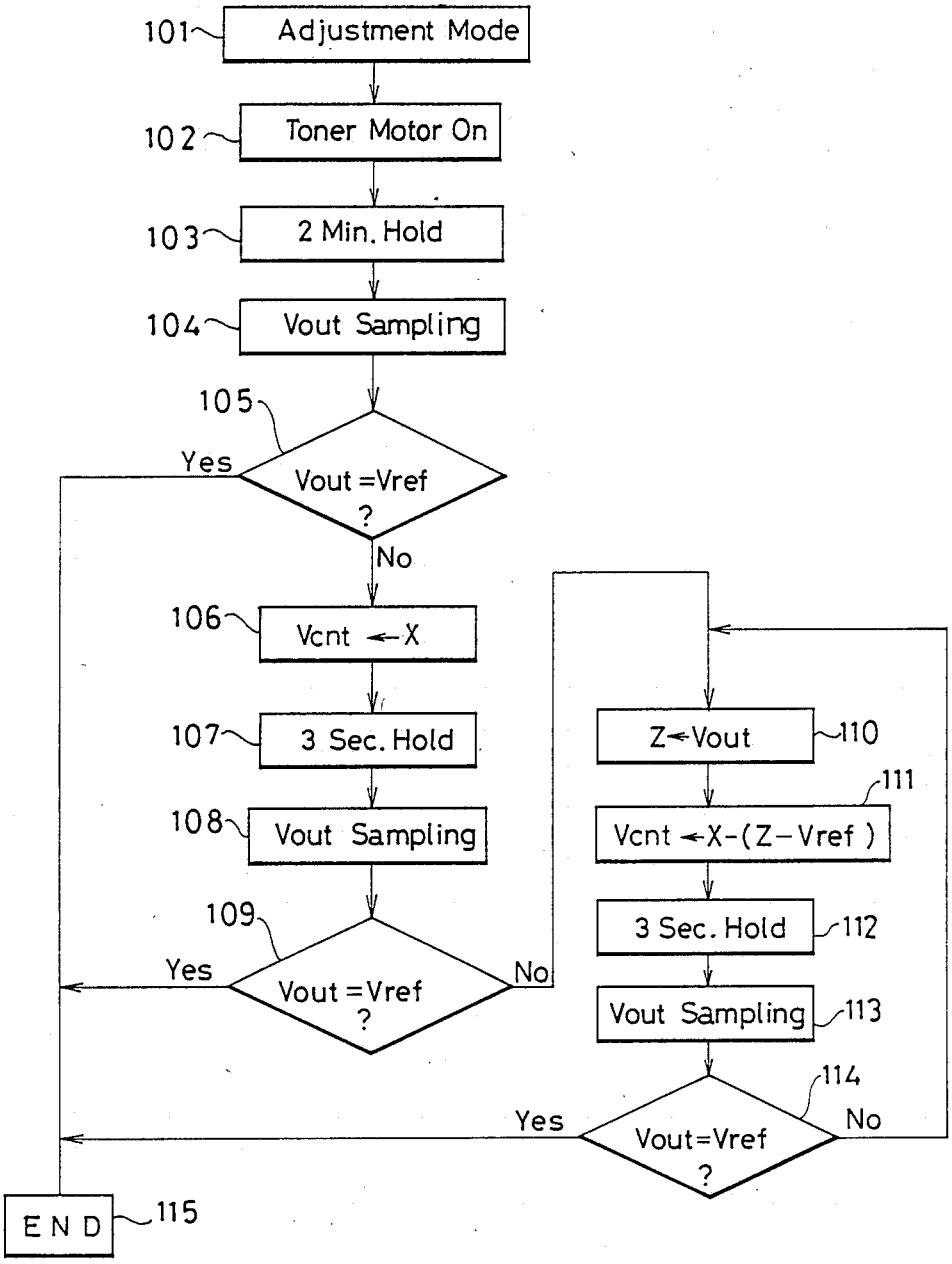
FIG. 5 is a flow chart of the operation of the auto-toner sensor shown in FIG. 2.

Referring now to FIG. 5, the operation of the initial adjustment by this auto-toner sensor will be explained.

After the power of the copy machine is turned on, the copy machine is put in an adjustment mode by an operator at the step 101 in order to carry out the initial adjustment. Then at the step 102 the toner motor (not shown) attached to the toner container 6 is turned on to release the toner from the toner container 6. Then after a two minute hold at the step 103, the toner density is sampled at the step 104 by the sensor 1 to produce the sensor output voltage $V_{out}$ which is then compared with the reference voltage $V_{ref}$ in the CPU 3 at the step 105. If the sensor output voltage $V_{out}$ and the reference voltage $V_{ref}$ is equal, then the adjusted voltage $V_{ad}$ in the CPU 3 at this time is memorized by the memory of the CPU 3 and the operation terminates at the step 115. Otherwise, the control voltage $V_{cnt}$ is brought back to its initial value x again at the step 106, and then after a three second hold at the step 107, the toner density is sampled at the step 108 by the sensor 1 again to produce the sensor output voltage $V_{out}$ which is then compared with the reference voltage $V_{ref}$ in the CPU 3 at the step 109 again. As in the step 105, if the sensor output voltage $V_{out}$ and the reference voltage $V_{ref}$ is equal, then the adjusted voltage $V_{ad}$ in the CPU 3 at this time is memorized by the memory of the CPU 3 and the operation terminates at the step 115. Otherwise, the control voltage $V_{cnt}$ is set to the value $[x-(V_{out}-V_{ref})]$ at the steps 110 and 111, and then after a three second hold at the step 112, the toner density is sampled at the step 113 by the sensor 1 again to produce the sensor output voltage $V_{out}$ which is then compared with the reference voltage $V_{ref}$ in the CPU 3 at the step 114 again. As in the step 105, if the sensor output voltage $V_{out}$ and the reference voltage $V_{ref}$ is equal, then the adjusted voltage $V_{ad}$ in the CPU 3 at this time is memorized by the memory of the CPU 3 and the operation terminates at the step 115. Otherwise, the steps 110 to 114 are repeated until the sensor output voltage $V_{out}$ and the reference voltage $V_{ref}$ become equal to each other.

After this initial adjustment, the copy machine is switched to a copy mode automatically, and the CPU 3 controls the toner supply controller 5 such that when the value of the reference voltage $V_{ref}$ is greater than that of the sensor output voltage $V_{out}$ the supply of the toner is started, and otherwise the supply of the toner is stopped. The supply controller 5 controls the toner motor (not shown) attached to the toner container 6 in accordance with the toner control signal from the CPU 3 to actually start or stop the toner supply.

As a result, in this embodiment of the auto-toner sensor, the toner density can always be maintained at the appropriate level automatically without requiring the operator to perform the cumbersome initial adjustment, as the initial adjustment of the sensor is also performed automatically.

It is to be noted that although the sensor 1 in the embodiment explained above was the magnetic type sensor, this can be replaced by a sensor of optical type without a change in the effectiveness of the present invention. Similarly, although the memory to memorize the adjusted voltage $V_{ad}$ in the embodiment explained above was incorporated inside the CPU 3, an external memory may be employed for this purpose.

Besides these, many modifications and variations of this embodiment may be made without departing from the novel and advantageous features of the present invention. Accordingly, all such modifications and variations are intended to be included within the scope of the appended claims.

What is claimed is:

1. An auto-toner sensor, comprising:

sensor means for detecting a toner density, and producing a sensor output signal indicating the detected toner density, the sensitivity of the sensor means being adjustable by a control signal supplied to the sensor means in an initial adjustment;

means for comparing a value of the sensor output signal with a prescribed reference value indicating an appropriate level of toner density, to produce a comparison signal indicating a result of the comparison; and means for producing a control signal applied to the sensor means, which adjusts the sensitivity of the detection of the toner density in the initial adjustment in accordance with the comparison signal, the control signal having a value such that the value of the sensor output signal is substantially equal to that of the reference value when the toner density is at the appropriate level.

2. The auto-toner sensor of claim 1, wherein the control signal is reset to a certain value after the comparison by the comparing means is carried out, and wherein the comparison by the comparing means takes place after an elapse of a predetermined period of time from a previous resetting of the control signal.

3. The auto-toner sensor of claim 2, further comprising means for stirring the toner during the elapse of the predetermined period of time.

4. The auto-toner sensor of claim 1, wherein the sensor output signal, the comparison signal, and the control signal are all given in terms of voltages.

5. An auto-toner sensor, comprising:

sensor means for detecting a toner density, and producing a sensor output signal indicating the detected toner density, a sensitivity of the sensor means being adjustable by a control signal to be supplied to the sensor means in an initial adjustment;

means for comparing a value of the sensor output signal with a prescribed reference value indicating an appropriate level of the toner density, to produce a comparison signal indicating a result of the comparison;

means for producing a control signal applied to the sensor means, which adjusts the sensitivity of the detection of the toner density in the initial adjustment in accordance with the comparison signal, the control signal having a value such that the value of the sensor output signal is substantially equal to that of the reference value when the toner density is at the appropriate level;

memory means for memorizing the value of the control signal after the initial adjustment; and means for controlling a supply of toner such that the toner is supplied only when a value of the sensor output signal differs from the reference value in a manner indicating that the toner density is lower than the appropriate level, while the control signal having the memorized value is supplied to the sensor means after the initial adjustment.

6. The toner supplying apparatus of claim 5, wherein the control signal is reset to a certain value after the comparison by the comparing means is carried out, and wherein the comparison by the comparing means takes place after an elapse of a predetermined period of time from a previous resetting of the control signal.

7. The toner supplying apparatus of claim 6, further comprising means for stirring the toner during the elapse of the predetermined period of time.

8. The toner supplying apparatus of claim 5, wherein the sensor output signal, the comparison signal, and the control signal are all given in terms of voltages.

* * * * *